United States Patent [19]

Montesi

[11] Patent Number: 4,603,692

[45] Date of Patent: Aug. 5, 1986

[54] YOKE FOR THE HARNESS OF A RESPIRATOR

[75] Inventor: Edward N. Montesi, Barrington, R.I.

[73] Assignee: Siebe North, Inc., Charleston, S.C.

[21] Appl. No.: 612,576

[22] Filed: May 21, 1984

[51] Int. Cl.[4] ..... A62B 7/00

[52] U.S. Cl. ..... 128/207.11

[58] Field of Search ..... 128/207.11, 206.28, 128/206.26, 206.24, 206.21, 206.17, 206.12, 201.23, 201.24, 201.25, 206.27, 207.17, DIG. 26, 206.15, 206.16, 206.29; 16/DIG. 14

[56] References Cited

U.S. PATENT DOCUMENTS

| | | | |
|---|---|---|---|
| 2,206,061 | 7/1940 | Splaine | 128/206.15 |
| 2,742,039 | 4/1956 | Bloom | 128/201.23 |
| 2,746,087 | 5/1956 | Dolezal | 16/DIG. 13 |
| 2,942,602 | 6/1960 | Seeler | 128/201.23 |
| 3,574,306 | 4/1971 | Alden | 16/DIG. 13 |

FOREIGN PATENT DOCUMENTS

| | | | |
|---|---|---|---|
| 1104122 | 4/1961 | Fed. Rep. of Germany | 128/207.11 |
| 199669 | 4/1965 | U.S.S.R. | 128/207.11 |

*Primary Examiner*—Henry J. Recla

*Attorney, Agent, or Firm*—Abelman Frayne Rezac & Schwab

[57] ABSTRACT

A yoke for the face piece of a respirator is formed from plastics material and is provided with hinge portions of lesser thickness than the remainder of the yoke, which are stressed during assembly of the respirator to resiliently position wings of the yoke as dihedrals.

6 Claims, 4 Drawing Figures

YOKE FOR THE HARNESS OF A RESPIRATOR

FIELD OF THE INVENTION

This invention related to a yoke by means of which a harness of elastic straps may be attached to the face piece of a respirator, the straps being employed for securing the face piece over the nasal and oral areas of a user's face in surrounding sealing relationship with those areas.

BACKGROUND OF THE INVENTION

Respirators commonly include a face piece molded from a soft, pliable rubber-like material, the face piece supporting members for attaching one or more air-purifying cartridges to the face piece, and for attaching an exhalation valve, the said members being accommodated in apertures through the face piece.

In order to secure the face piece over the user's nasal and oral areas, straps are attached to rearward portions of the mask, the straps usually being of an elastic material for them to be passed over or around the user's head, and then adjusted for them to draw the mask into sealing relationship with the nasal and oral areas of the user's face in a continuous line or zone extending around the user's nose and mouth.

THE PRIOR ART

A typical example of such a respirator is disclosed in U.S. Pat. No. 4,414,973, Matheson et al. The respirator of that patent includes dual members for attaching air-purifying cartridges to the face piece and which are arranged at the lateral sides of a face piece, and, a centrally arranged exhalation valve. The face piece of this patent is to be held positioned on the user's head by a plurality of straps, the straps being secured to the mask by eyelets received over button-like members formed integrally with the face piece at positions adjacent to the peripheral edge thereof.

In this construction, any stresses imposed on or generated in the straps must be absorbed by the face piece itself. As a consequence, the face piece must be made of enhanced strength and resistance to distortion for it to resist such stresses.

It has been proposed to relieve the face piece from such stresses by attaching the harness of straps to a yoke that is attached to the face piece at a single point at the front of the face piece. While this construction has the advantage of relieving the face piece from distortions in lateral directions resulting from stresses set up in the straps, it tends to be less stable in its intended purpose of immobilizing the face piece in continuous sealing engagement with the user's face.

THE INVENTION CONCEPT

In accordance with the present invention, there is provided a yoke for securing a harness of straps to the face piece of a respirator, which, in addition to locating the face piece over the user's nasal and oral areas with greater stability and immobility, also acts to equalize the stresses produced in the straps, and to transfer those stresses to the face piece and to the user's face in a manner enhancing the seal provided by the face piece against the face of the user, despite facial differences of the user, who may be broad-featured, or sharp-featured, and have either a long or short facial profile.

According to the present invention, the yoke is comprised by a unitary laminar member of inverted butterfly shape formed from a stiff and relatively inflexible material, the wings of the butterfly shape being interconnected by a stiff and relatively inflexible central portion of the yoke through the intermediary of webs of lesser thickness than the thickness of the wings and central portion, and which act as spring-hinge members permitting resiliently restrained movement of the wings relative to the central portion.

The stiff and relatively inflexible central portion is attached to a planar front surface of the face piece at spaced positions lying in a vertical plane bisecting the face piece, for the wings to diverge outwardly from the face piece and be cantilevered and resiliently restrained against displacement.

Accordingly, the face piece is readily positionable in lateral directions for it to be brought into the required sealing relationship with the user's face, but is restrained from angular or rotational movement relative to the yoke. The interconnections of the yoke and face piece act to inhibit relative rotational movement between those members, other than about an axis lying in said plane and which passes through the said spaced positions of attachment of the yoke and face piece.

The stresses produced by the straps attached to the yoke also pass through that axis, and are equally and symmetrically dissipated in the face piece in a manner minimizing flexure and distortion of the face piece, the resilient interconnection of the wings of the yoke and the central portion thereof, also acting to dissipate and equalize such stresses.

The face piece can thus be formed from an extremely soft and pliable material and of relatively light weight, the danger of collapsing of the face piece under the stresses imposed thereon being eliminated by the equalization and distribution of the stresses.

Preferably, the yoke is apertured in order to reduce its weight and in order to accommodate the attachment of air-purifying cartridges to the face piece, and, in order that it may lie positioned between the face piece and the adjacent air-purifying cartridge. The yoke is also apertured to accommodate a frontly positioned exhalation valve, or a speaking diaphragm or cartridge if such device is provided.

Also, preferably, the yoke is in the form of three open interconnected trapezoidal shapes, which in combination act to stabilize the positions of the yoke under the stress loading of the straps.

Also, preferably, the yoke is a molding of plastics material which has been molded in a substantially flat or planar condition, and which has been subsequently bent about axes extending through the webs to permanently deform the webs and enhance their resilient resistance to further flexing moments.

DESCRIPTION OF THE DRAWINGS

The invention will now be described with reference to the accompanying drawings, which illustrate a preferred embodiment of the invention, and, in which.

DESCRIPTION OF THE PREFERRED EMBODIMENTS

Figure 1:
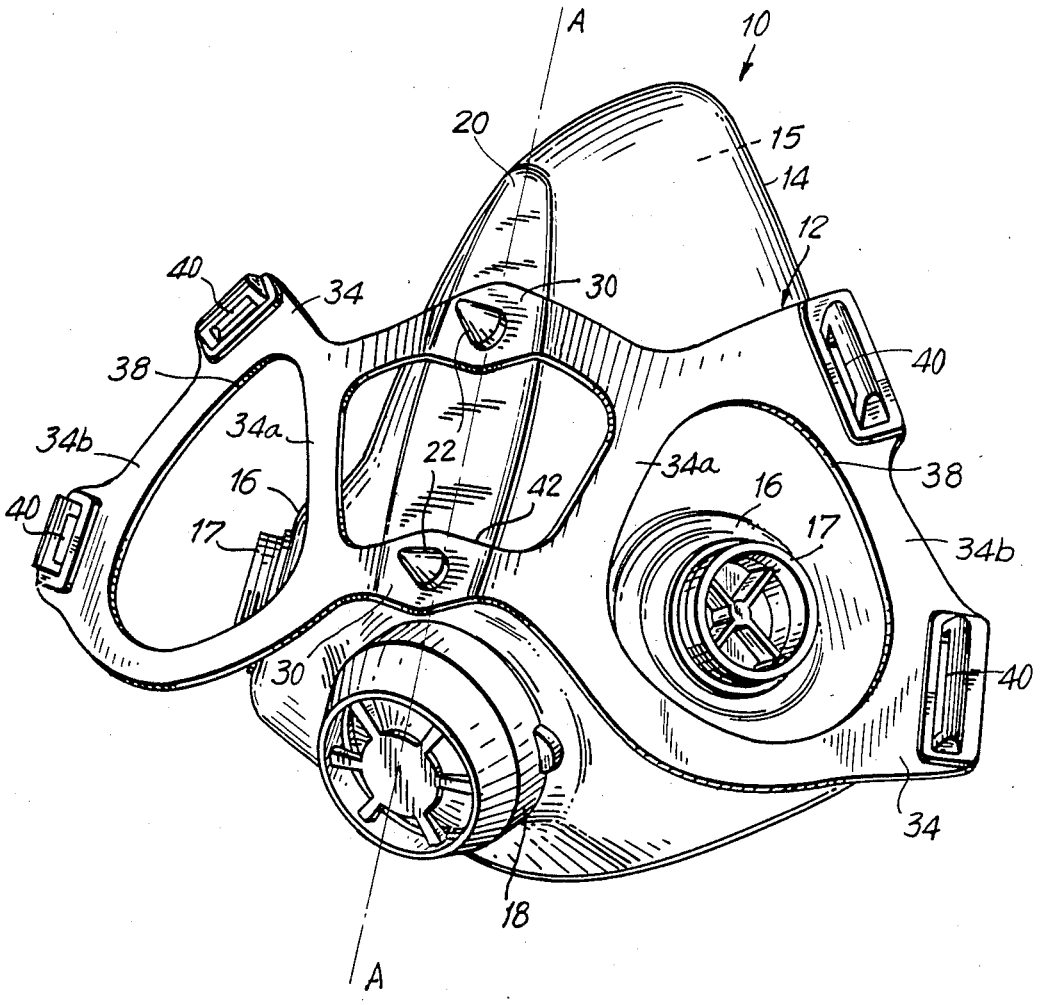
FIG. 1 is a perspective view of the yoke of the present invention shown attached to a respirator face piece.

In the drawings, the face piece is indicated at generally at 10, and the yoke is indicated generally at 12. The face piece may be formed from any soft pliable and flexible elastomeric material, such as a soft rubber, as is well-known in the art, a preferred material for use in the face piece being a soft and pliable silicone rubber. As is also well known in the art, the face piece is provided with flexible flanges 14 at the rear edges thereof for engagement with the user's face in a continuous line or area extending about the nasal and oral areas of the user's face, for the user's nose and mouth to be located within the confines of the face piece. The face piece extends forwardly of the user's face to provide a confined air space 15 within the face piece, and is suitably apertured to accommodate supporting members 16 for air purifying cartridges (not shown) which are attachable to threaded portions 17 of the supporting members. The face piece is also suitably apertured to accommodate an exhalation valve 18.

The front face of the face piece is formed with a substantially flat and planar surface 20, from which extend two securing members or buttons 22, the buttons 22 being molded integrally with the face piece and thus being of the same pliable and flexible material as the face piece. Preferably, the buttons are of forwardly conical shape, as illustrated, to facilitiate their insertion through apertures in the yoke 12, as is later described.

The buttons 22 are spaced vertically of the planar surface 20, for them to lie in a vertical plane which includes the axis A—A indicated in FIG. 1, and which bisects the face piece 10.

Figure 2:
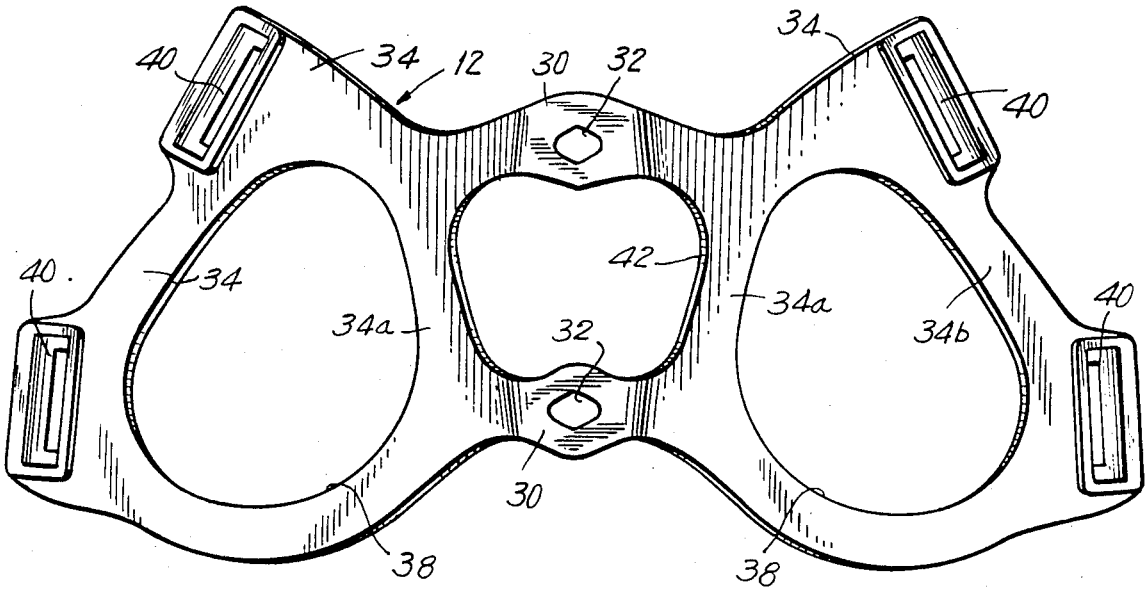
FIGS. 2 and 3 are front and rear elevations of the yoke, respectively, in the flattened or planar condition in which it is manufactured; and, FIG. 4 is a plan view of the yoke of the present invention, shown attached to a face piece, as illustrated in FIG. 1.
Figure 3:
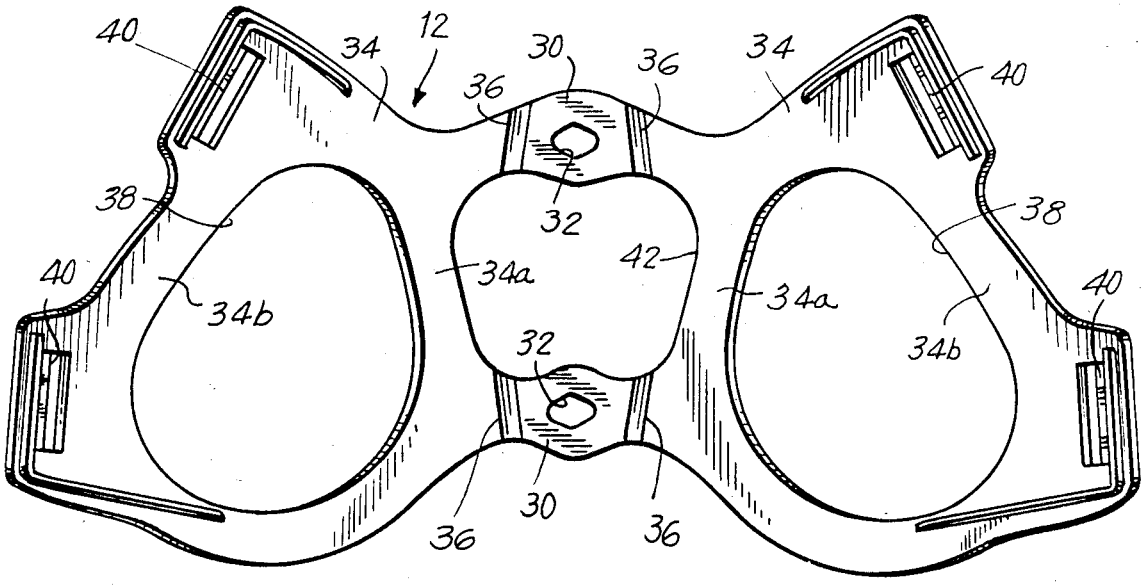
Figure 4:
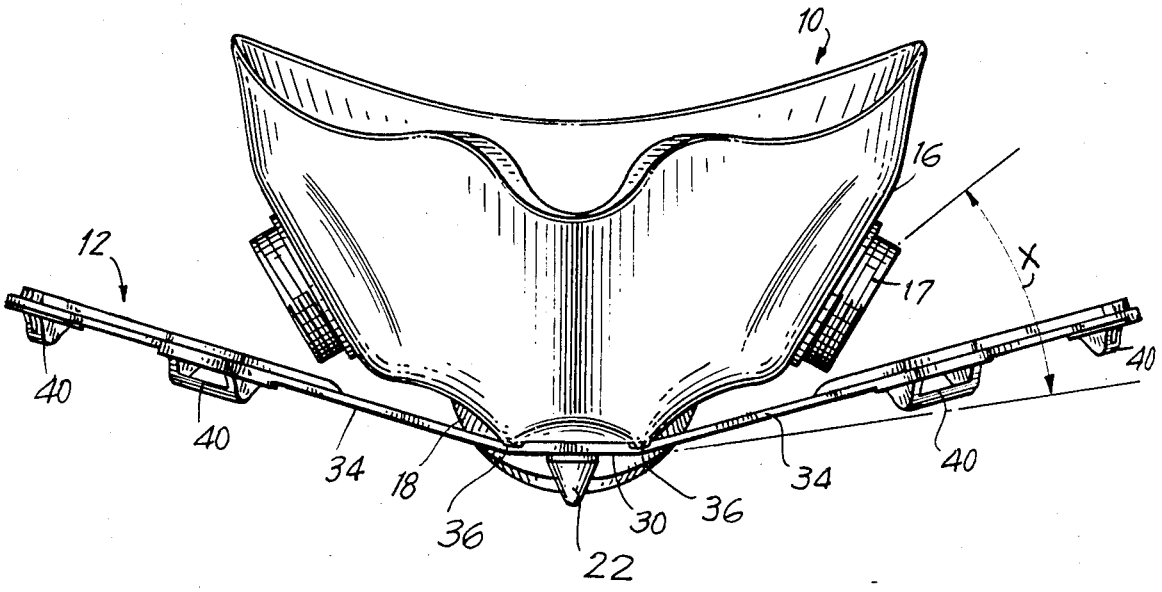

The yoke 12 is comprised of a unitary lamina and includes a central or medial portion 30, which, as is more clearly illustrated in FIGS. 2 and 3, is apertured at 32 for it to receive the buttons 22, the buttons having suitably undercut portions to restrain them from removal from the apertures 32,32, and for them to retain the yoke 12 firmly attached to the face piece 10 with the said central portion 30 engaged by and firmly seated on the planar surface 20 of the face piece. The yoke 12 may be formed from any suitable plastics material, such as hard nylon, polyolefin, or a similar material, and preferably is formed as a substantially planar molding of that material, as illustrated in FIGS. 2 and 3, which is subsequently bent to form dihedrals, as illustrated in FIG. 4. Typically, the yoke 12 will have a thickness in the order of 0.05 inches, but may be of greater or lesser thickness depending on the specific plastics material employed in its manufacture.

Extending from each side of the central portion 20, are wing portions 34, the wings being a mirror image in shape of each other. The wings 34 are respectively connected with the central portion 30 through the intermediary of hinge portions 36 which are positioned slightly beyond the side edges of the planar surface 20, the hinge portions 36 being of lesser thickness than that of the central portion 30 and that of the wings 34, for example, of a thickness of 0.025 inches.

As will be more clearly apparent from FIG. 3, the hinge portions 36 at the opposite sides of the medial portion 30 are arranged in lines that are inclined relative to each other and which are also inclined relative to the said plane including the axis A—A. Thus, upon flexure of the yoke 12 about the hinge lines 36, compressive stresses are set up in the wings 34 which tend to cause the wings to assume an outwardly dished concave shape instead of being substantially planar.

The formation of the hinge portions 36 for them to be of lesser thickness than that of the central portion 30 or the wings 34, and thus of greater flexibility, insures that the yoke will flex predominantly or exclusively along the lines of the hinge portions 36. Upon the assembly of the yoke onto the face piece and the orientation of the wings 34 as dihedrals, the wings 34 become accurately oriented and positioned at the sides of the face piece in an entirely predictable manner, as is illustrated in FIG. 4. Additionally, the wings tend to assume a concave shape, more readily conforming the wings to the exterior configuration of the mask and further equalizing the stresses produced by the straps.

Subsequent to the assembly of the yoke onto the face piece, air-purifying cartridges (not shown) are attached to the face piece 10 by threading them onto the threaded portions 17 of the supporting members 16. In order to provide access to the threaded portions 17, the respective wings 34 are apertured at 38 for the wings to lie located and confined between the face piece 10 and the respective air-purifying cartridges. In this position, the wings of the yoke are constrained against outward movement, but are still moveable between a position in which they engage the adjacent air-purifying cartridge, and a position in which they engage the adjacent outer surface of the face piece. This is illustrated in FIG. 4 as permitted resiliently restrained hinging movement of the wings through the angle "X", the probability being that prior to the positioning of the respirator over the user's head, the wings will be resiliently biased outwardly into engagement with the adjacent air-purifying cartridge.

Bails 40 are provided on the yoke for the attachment of the usual elastic straps (not shown) used for holding the respirator positioned on the user's head.

As will be apparent, within a range determined by the permitted movement "X" of the respective wings 34, the straps will exert a direct pull on the respective wings to place them in tension, to the exclusion of any lateral bending movements exerted on the wings, the wings themselves being capable of movement into alignment with the forces exerted by the straps.

In this manner, it is arranged that the forces exerted by the straps on the respective wings 34 are transmitted through the respective hinge portions 36 and directly to the central portion 20, where they are resolved as opposing inclined tensional forces. The resultant of those forces acts to draw the face piece 10 perpendicularly into intimate sealing engagement with the user's face, to the substantial exclusion of any forces acting laterally of that plane and which could cause the face piece to lift or distort at the peripheral edge thereof. By this construction, improved protection factors can be obtained, since the effect of changes in strap tension and angular vectors created predominately in the lower (neck) strap as the wearer turns his/her head from side to side are more compensatingly resolved thus adding to face piece stability. Further, by attaching the yoke 12 to the face piece 10 at positions spaced vertically in the plane of the axis A—A, and by seating the central portion 30 of the yoke 12 on the planar surface 20 of the face piece, unequal stresses imposed on the wings by the elastic straps are further equalized and uniformly distributed within the yoke. The forces are resolved in the face piece 10 as a substantially uniform force acting perpendicularly of the front face of the face piece, and thus throughout the entire perimeter of the mask, this resulting in the elimination of high pressure spots or zones, such as can cause severe discomfort and annoyance to the wearer of the respirator.

This equalization of the forces will occur even in the event that the face piece should be positioned slightly off-center on the user's face, in that the central portion 30 of the yoke is free to pivot about the hinge portions 36 and redistribute and equalize the pressures exerted by the face piece on the user's face, again resulting in the force transmitted by the yoke being in the direction of the plane of the axis A—A.

Of importance in this respect is the securing of the yoke 12 to the face piece 10 at vertically spaced positions medially of the face piece, the face piece being oppositely symmetrical on both sides of the plane including the axis A—A. In the presence of rotation of the yoke and face piece relative to each other in the plane of the surface 20, then, the face piece 10 would move out of symmetry with respect to the yoke 12, and, forces would be produced in the face piece on opposite sides of a plane transverse to the axis A—A and extending through the point of relative rotation between the yoke and the face piece, with consequential discomfort to the wearer of the respirator.

As the wings 34 are hinged to the central portion 20 of the yoke, albeit resiliently restrained, the wings 34 can move between the extremes of the angle "X". In this manner, within a determined range of skull widths of various users, the advantages of equalization of the forces transmitted to the face piece is retained, the wings assuming a widely splayed position if the respirator is worn by a person having a broad skull, and moving towards a more narrowly splayed position if the user has a lesser skull width.

As illustrated in the drawings, yoke 12 in addition to being provided with apertures at 38, also is provided with a central aperture 42 which extends entirely through the central portion 30 and into the respective wing portions 34. In this manner, yoke 12 is of universal application to face pieces having lateral support members for the attachment of air-purifying cartridges, or, ones in which the air-purifying cartridge replaces the exhalation valve 18, the exhalation valve then being located in the planar surface 20 and intermediate the securing members 22.

A considerable advantage arises from this triptych arrangement of the apertures 38 and 42, and the resulting open framework form of the yoke 12. Not only is the yoke 12 of reduced weight, but, to the greatest possible extent its strength and rigidity is preserved, while at the same time facilitating the transmission and equalization of the stresses produced in the yoke.

As so formed, the yoke 12 is of inverted butterfly shape, the respective apertures effectively dividing the yoke into three interconnected substantially trapezoidal portions.

The outermost ones of those portions are provided by a major portion of the wings 34, the bails 40 for connection of the straps being located at the outermost adjacent pairs of corners of the respective wing portions 34. The innermost sides of the outermost pair of trapezoidal portions are comprised by the bridging members 34*a* of the wing portions 34, the bridging portions 34*a* constituting opposite sides of a trapezoidal portion intermediate the outer trapezoidal portions. The intermediate portion is comprised by the central portion 30 and the interconnected portions of the wing members 34.

By this construction, stresses exerted by straps attached to the respective bails 40 are transmitted directly to both of the securing members 22. In the absence of the dual securing members 22, the resulting forces would tend to rotate the yoke relative to the face piece, with the consequences previously described. Any such attempted relative rotation is prevented by the dual attachment of the yoke to the face piece, with the result that the forces produced by each one of the straps is resolved in both of the securing members, with better equalization of the forces transmitted to the face piece. Further, any tendency of the respective pairs of bails to move towards or away from each other is effectively resisted by the bridging portions 34*a* and 34*b*, which act as struts maintaining the respective bails 40 in correctly spaced positions relative to the adjacent bail.

It will be appreciated that the structure described above is a preferred embodiment of the present invention, and, that various modifications of the structure may be made without departing from the scope of the appended claims. For example, in the event that the yoke is to be employed solely with a face piece having dual air-purifying cartridges, then, the central aperture 42 could be omitted. Conversely, if the face piece is to have a single air-purifying cartridge and a centrally arranged exhalation valve, then, the shape of the apertures 38 could be approximately modified to decrease the extent of the lower lobes of the wings 34.

I claim:

1. A yoke for a respirator, comprised by:

a unitary lamina of stiff plastics material including;

an apertured, substantially trapesoidal medial portion of said lamina for attachment to a front face of a respirator face piece;

apertured substantially trapesoidal wing portions provided by said lamina and extending laterally of said medial portion symmetrically about a line bisecting said medial portion;

hinge portions provided by said lamina and interconnecting the respective said wing portions with said medial portion, said hinge portions being comprised by portions of said lamina of lesser thickness than the remainder of said lamina; and, strap connection means located at corners of said wing portions remote from said medial portion.

2. The yoke of claim 1, in which said wing portions are inclined relative to said medial portion and form dihedrals of said lamina.

3. A respirator including:

a face piece having a substantially planar front wall;

a unitary lamina formed from a stiff plastics material, and including an apertured, substantially trapezoidal medial portion attached to said planar front wall of said face piece;

apertured, substantially trapezoidal wing portions of said lamina extending laterally of said medial portion and symmetrically arranged about a line bisecting said medial portion;

hinge portions provided by said lamina and interconnecting the respective said wing portions with said medial portion, said hinge portions being of lesser thickness than the remainder of said lamina and being located at respective opposite sides of said substantially planar front wall of said face piece; and, strap connection means at corners of said wing portions remote from said medial portion.

4. The respirator of claim 3, including spaced attachment members positioned on said planar front wall and positioned in a substantially vertical plane bisecting said face piece, said attachment members extending through apertures in said medial portion and being operative to inhibit relative movement between said face piece and said medial portion.

5. The respirator of claim 3, in which said hinge portions provide a resilient bias against relative movement between said wing portions and said medial portion, said wing portions being moveable towards said face piece against the resilient bias of said hinge portions.

6. The respirator of claim 3, in which said hinge portions extend along lines inclined relative to said vertical plane, the hinge portions at opposite sides of said medial portion including portions inclined relative to each other.

* * * * *